United States Patent [19]

Daniel, deceased et al.

[11] 4,407,456

[45] Oct. 4, 1983

[54] MIXING NOZZLE

[76] Inventors: Hugh O. Daniel, deceased, late of Oakland, Calif.; by Lucille W. Daniel, administratrix, 532 Lewis St., San Leandro, Calif. 94577

[21] Appl. No.: 248,314

[22] Filed: Mar. 27, 1981

[51] Int. Cl.[3] ..... B05B 7/04

[52] U.S. Cl. ..... 239/423; 239/600; 239/434.5

[58] Field of Search ..... 239/423, 424, 434.5, 239/310, 313, 316, 318, 569, 600

[56] References Cited

U.S. PATENT DOCUMENTS

| | | | |
|---|---|---|---|
| 272,863 | 2/1883 | Douglas | 239/424 X |
| 1,017,585 | 2/1912 | Pattin | 239/424 X |
| 1,318,616 | 10/1919 | Smith | 239/424 |
| 1,613,795 | 1/1927 | Herold | 239/424 X |
| 2,981,284 | 4/1961 | Putnam | 239/569 X |
| 4,123,005 | 10/1978 | Blunk | 239/434.5 X |

FOREIGN PATENT DOCUMENTS

| | | | |
|---|---|---|---|
| 434196 | 11/1911 | France | 239/424 |
| 568 | of 1865 | United Kingdom | 239/424 |

*Primary Examiner*—John J. Love
*Assistant Examiner*—Paul A. Sobel
*Attorney, Agent, or Firm*—George W. Wasson

[57] ABSTRACT

A mixing nozzle for producing a small cross-section liquid stream of a first liquid mixed with a second liquid. The nozzle is adapted to be attached to a conventional plumbing hose and includes a nozzle portion for forming the small cross-section liquid, an inner channel member fitted within the nozzle portion and an inlet hole for introducing the second liquid into the nozzle portion between the inner surface of the nozzle and the outer surface of the inner channel.

1 Claim, 6 Drawing Figures

MIXING NOZZLE

This application is a substitute application for application Ser. No. 011,363, filed Feb. 12, 1979 by Hugh O. Daniel for Mixing Nozzle, now abandoned.

BACKGROUND OF THE INVENTION

Mixing nozzles have been known and have been in general use. One such device is my prior U.S. Pat. No. 3,052,417 issued Sept. 4, 1962 for Dispensing Apparatus. Prior Art nozzles have been complicated and have required many parts to accomplish the mixing of materials into a liquid stream. The apparatus of the present invention is a mixing nozzle with few parts and simplified construction.

Liquid streams can be used to project liquid and other materials, such as cleaning detergents, to an otherwise almost inaccessible spot. One use for such a projected stream is the cleaning of windows or other surfaces that are beyond convenient reach from a nonhazardous location. For example, in many modern homes and buildings tall or high glass walls are employed. The cleaning of those surfaces from ground level has presented a serious challenge.

Cleaning liquids are not the present limiting factor in accomplishing the desired cleaning. Detergents have been developed and improved that will clean the surfaces if they can be projected to the surfaces and spread with reasonable uniformity along the surface.

The mixing nozzle of the present invention may be used to accomplish the desired projection and spreading from substantial distances away from the surface. Further the mixing nozzle disclosed herein may be used to easily introduce detergents or other cleaning materials into a projected liquid stream. The nozzle is quickly changed from its mixing function to a clear stream projector and with ease.

OBJECTIVES OF INVENTION

It is an object of the present invention to provide a simple mixing nozzle having a minimum of parts and adapted to be used with conventional liquid sources to form a small cross-section liquid stream.

A further objective is to provide a mixing nozzle as in the preceding objective adapted to mix materials into the liquid stream.

A further objective is to provide an internal construction for the nozzle of the preceding objectives that will insure a passageway for materials to be mixed with the liquid stream.

A further objective of the present invention is a mixing nozzle adapted to be easily attached to conventional liquid sources and equipped with simple means for controlling liquid flow through the nozzle.

Other objectives and features of the present invention will be readily apparent to those skilled in the art from the specification and appended drawings illustrating a preferred embodiment wherein.

DESCRIPTION OF THE INVENTION

Figure 1:
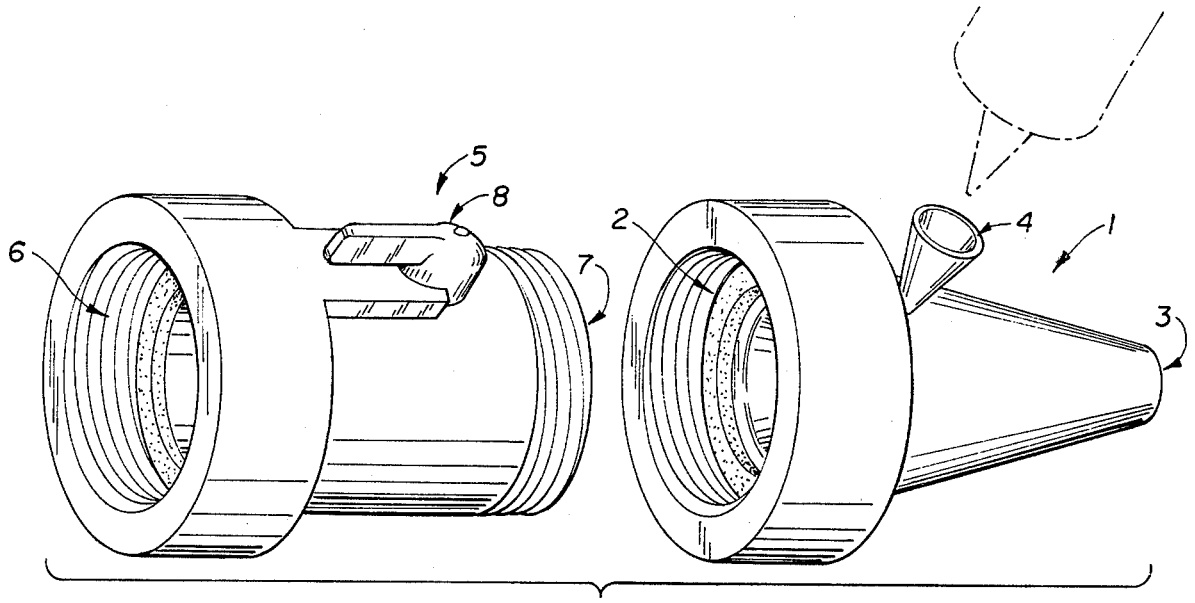
FIG. 1 is an exploded perspective view of the nozzle of the present invention illustrating its use with a valving attachment.

As illustrated in FIG. 1 the present invention comprises a nozzle 1 adapted to be attached to a source of liquid as at end 2, to produce a confined small cross-section stream of liquid from end 3 and to mix with that stream an introduced material through passageway 4.

The end 2 of the nozzle is provided with conventional hose threads so as to be connectable to a convention hose system. The end 3 has a substantially smaller cross-section than the entry end 2 so as to constrict the flow of liquid through the nozzle. In that manner the volume of liquid entering at end 2 at a first velocity exits at end 3 at a substantially higher velocity in order to move the volume of liquid through the nozzle. The small cross-section liquid stream exiting from the nozzle at the higher velocity has the momentum and potential energy to develop a substantial range for the liquid stream. The inlet passageway 4 is adapted to accommodate the spout of a container for the introduced material. In FIG. 1 the container is shown in phantom to illustrate a source that may take many forms.

FIG. 1 also illustrates the possible use of a metering element 5 with the nozzle 1. The element 5 is adapted at an inlet end 6 with conventional threads for attachment to a conventional hose system. The opposite end 7 is adapted with conventional threads for attachment to the inlet end 2 of nozzle 1. The element is further adapted with an internal valve system, as will be described, with an external operator 8.

The metering element is not essential to the present invention; however, the feature of providing a control of the liquid source at the nozzle, both for "ON"-"OFF" control and for volume control, makes the nozzle more readily useable in controlling liquid passed from the nozzle.

Figure 2:
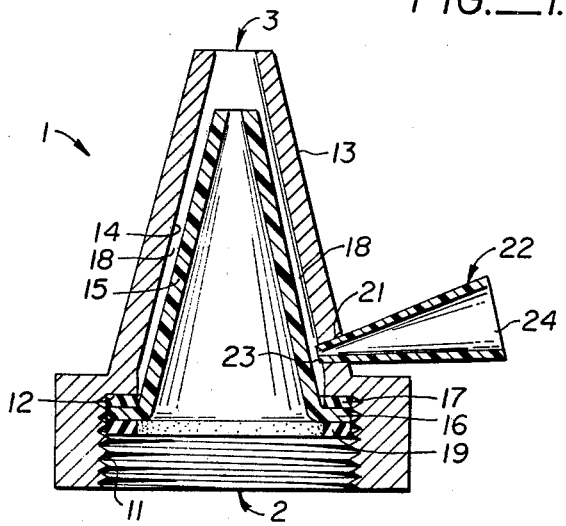
FIG. 2 is a sectional view through the nozzle of the present invention.

FIG. 2 illustrates, in cross-section, the internals of the nozzle 1. The threads 11 at the entry end 2 are conventional female hose threads. The nozzle is formed, both inside 13 and outside 14, in a circular cone form tapering toward the exit end 3. An internal annular shoulder 12 separates the threaded end 11 from the inside cone surface 13.

Inside the nozzle an inner channel member 15 is positioned to provide a flow channel for liquid from the inlet end 2 toward the exit end 3. The inner channel has an outwardly directed flange at 16 for cooperation with shoulder 12 to position the channel. Channel member 15 is also a circular cone with the same slope angle with respect to its axis of symmetry as the slope angle of the inside surface 14 of nozzle 1. A washer 17 is positioned against the surface of flange 16 in contact with shoulder 12 and in a press fit against threads 11 so as to positively hold channel 15 in the nozzle 1. A second washer 19 contacts the threads 11 and holds the channel member 15 against washer 17 and shoulder 12.

The dimensions and slope of the cone portion of channel 15 and the flange 16 are arranged with respect to the dimensions of the inside cone surface 14 so as to establish a space 18 between the outside of the channel and the inside cone surface 14. With the same slope on the channel and the nozzle, the space 18 is the same along the axis of the cone portion of the nozzle.

At one side of the nozzle, as shown in FIG. 2, a hole 21 is cut radially through the cone portion so as to provide a means for communicating with the space 18 between the channel 15 and the inside of the nozzle. A passageway member 22 is positioned with its exit end 23 within the hole 21 and its inlet end 24 outside of the nozzle. In its preferred form the passageway element 22 is a circular hollow cone form adapted to accommodate the spout of a container for materials to be mixed into the liquid stream passing through the nozzle 1.

Figure 3:
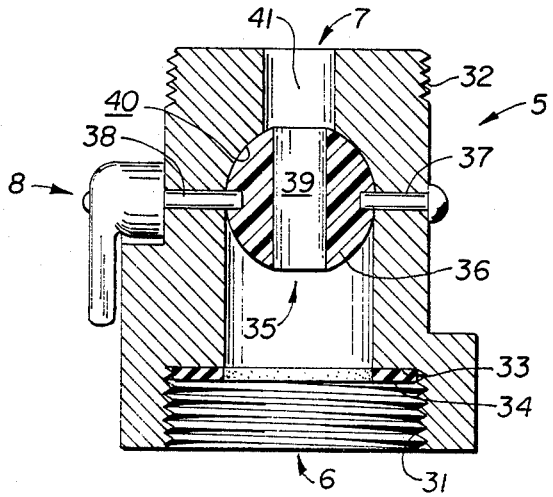
FIG. 3 is a sectional view through a valving attachment.

FIG. 3 illustrates, in cross-section, a metering element 5 for the nozzle 1 of the present invention. The metering element has an entry end 6 with conventional internal female hose threads at 31 and external male hose threads 32 at the exit end 7. Threads 31 are adapted to connect the element 5 to a hose and threads 32 are adapted to cooperate with the threads 11 of the nozzle 1 to connect the two elements together and to a hose source of liquid. A shoulder 33 and washer 34 at the inlet end 6 are provided to establish a fluid tight connection between the hose and the assembled metering element and nozzle.

Inside the metering element 5 there is provided a valving system 35 with an external operator 8. The valve here shown is a ball 36 rotatable with a pair of aligned axle pins 37 and 38. Pin 37 is peened over at the outside and pin 38 is adapted, with conventional means, to cooperate with a handle operator in such a way as to rotate the ball within the metering element when the operator is rotated outside the element. Ball 36 has a hole 39 cut through it in such a form that the hole is in axial alignment with the element in one position of operator 8 and perpendicular to the axis of the element in the other position of the operator 8. The inside end of the metering element 5 nearest its exit end 7 has a concave hemispherical surface 40 of substantially the same arc of curvature as the enterior surface of the ball 36. A hole 41 passes through the concave surface in alignment with the axis of the element 1 and the axis of the hole 39 through ball 36 so as to provide the liquid flow path through the element.

When the operator 8 and ball 36 are rotated to position hole 39 in any position other than axial alignment with the axis of hole 41, the ball operates to meter the amount of liquid flowing through the element by constricting the cross-section of the liquid flow path. The metering provided by the ball valve 35 is substantially continuous between full "ON" and full "OFF".

Figure 4:
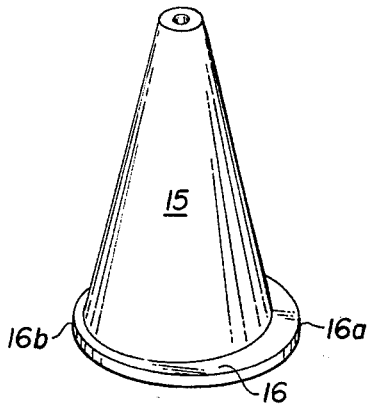
FIG. 4 is a perspective view of one form of the inner channel.
Figure 5:
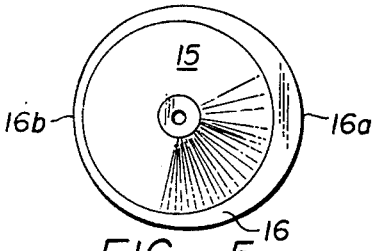
FIG. 5 is a top plan view of the inner channel of FIG. 4.
Figure 6:
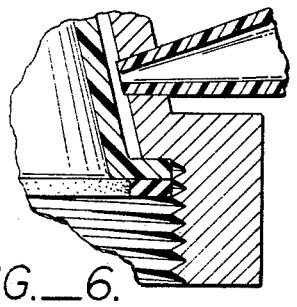
FIG. 6 is a partial cross-section view showing an alternative positioning of the inner channel within the nozzle.

FIG. 4 and FIG. 5 illustrate an alternative configuration of the radial flange 16 for the channel 15. As shown therein the flange 16 is larger at one side 16*a* than at the other 16*b*. With this configuration, and with correct positioning within the nozzle 1, the channel with insure that a space is provided between the passageway 22 and the inside of the nozzle. Correct positioning will place the larger part 16*a* of the flange adjacent the side of the nozzle where hole 21 is cut.

From the foregoing description of the elements of the nozzle and metering attachment of the present invention its operation should be readily apparent. The invention is particularly adapted to the washing of windows or other inaccessible surfaces. A liquid source of reasonable pressure connected to the inlet portion of the nozzle 1 or to the metering element 5 connected to the nozzle 1 and adjusted by operator 8 can produce a stream of small cross-section at exit end 3 with sufficient velocity to permit the stream to contact surfaces at a reasonable distance. The user of the nozzle may be far enough away to avoid being wetted by splashing from stream as it contacts the surface.

The nozzle's mixing capability is provided by introducing materials through the passageway 22. Introduced materials fill the space 18 between the channel 15 and the inside surface 14 of the nozzle 1. The velocity of the liquid flow through the channel 15 and out through the exit end 3 of the nozzle creates a partial vacuum in the area of the exit. The vacuum draws the material from the annular space 18 and the liquid stream carries the material to the surface to be cleaned. The vacuum and mixing action is created by the venturi configuration of the elements and the flow of the liquid stream through the nozzle.

When assembled as a unit of a nozzle and a metering element, the operator 8 may be adjusted to control the volume of liquid passing through the nozzle. The introduction of materials through passageway 22 can be controlled to supply materials only for a part of the time liquids are flowing through the nozzle. In that manner an initial clear liquid flow may be followed by a flow of mixed materials and further followed by a flow of clear liquid. Very little materials are needed because of the complete mixing action and because the materials are drawn into the stream in a gradual manner.

I have found that for the purposes of washing windows or other exterior surfaces a mixture of mild, concentrated household detergent, commercially available liquid ammonia solutions and, in some cases, a water softener provides a simply mixed and inexpensive material. The proportions of mix of the materials will depend on the severity of the cleaning job particularly with respect to the need for water softeners. I have further found that most household water systems have adequate pressure and volume to produce a stream from the nozzle that will reach most household windows.

While certain preferred embodiments of the invention have been specifically disclosed it should be understood that the invention is not limited thereto as many variations will be readily apparent to those skilled in the art and the invention is to be given its broadest possible interpretation within the terms of the following claims.

What is claimed is:

1. Apparatus for producing a small cross-section liquid stream from a liquid source and adapted for mixing a second material with said liquid stream comprising:

a nozzle member having means at one end of connection to said liquid source and means at a second end for forming said small cross-section liquid stream;

said nozzle member having a truncated cone shape portion narrowing in cross-section toward said second end and having an internal shoulder near said one end;

an inner channel member positioned within said nozzle member, said channel having an annular outwardly extending flange;

said flange of said channel member and said shoulder of said nozzle member cooperating to position said channel within said nozzle member so as to provide an annular space between the interior of said nozzle member truncated cone shape portion and the exterior of said channel;

said flange of said channel member including means to positively position said channel within said nozzle member to establish said annular space between said channel and said cone shaped portion;

said flange of said channel member being eccentric to said channel to accomplish said positive positioning of said channel within said cone shaped portion; and a cut out portion through said cone shaped portion to establish a passageway to said annular space between said channel and said cone shaped portion;

said nozzle member, channel and passageway being so constructed and arranged that materials introduced through said passageway are mixed said liquid stream passing through said nozzle.

* * * * *